US009508325B2

(12) United States Patent
Yamamoto

(10) Patent No.: US 9,508,325 B2
(45) Date of Patent: Nov. 29, 2016

(54) WHITE KEY OF KEYBOARD INSTRUMENT

(71) Applicant: Yamaha Corporation, Hamamatsu-shi, Shizuoka-ken (JP)

(72) Inventor: Shin Yamamoto, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 14/880,113

(22) Filed: Oct. 9, 2015

(65) Prior Publication Data

US 2016/0104463 A1 Apr. 14, 2016

(30) Foreign Application Priority Data

Oct. 9, 2014 (JP) ..... 2014-208134

(51) Int. Cl.
*G10C 3/12* (2006.01)

(52) U.S. Cl.
CPC ..... *G10C 3/12* (2013.01)

(58) Field of Classification Search
CPC ..... G10C 3/12; G10C 3/125; G10C 9/00; G10H 1/346; G10H 1/344; G10H 2220/221; G10H 1/32; G10D 13/085
USPC ..... 84/423 R, 433, 423, 438
See application file for complete search history.

(56) References Cited

U.S. PATENT DOCUMENTS 7,394,004 B2 * 7/2008 Muramatsu ..... B29C 45/16 84/174
7,608,772 B2 * 10/2009 Kato ..... G10C 3/12 84/423 R

FOREIGN PATENT DOCUMENTS

JP H06-060887 A 8/1994
JP 2007-139885 A 6/2007

* cited by examiner

*Primary Examiner* — Kimberly Lockett
(74) *Attorney, Agent, or Firm* — Morrison & Foerster LLP

(57) ABSTRACT

A white key of a keyboard instrument includes: an upper wall elongated in a front and rear direction; and a pair of side walls extending downward respectively from right and left edges of the upper wall and each elongated in the front and rear direction. The upper wall and the pair of side walls define an inner space opening downward. The upper wall and the pair of side walls include: a narrow portion and a wide portion wider in a right and left direction. The white key has right and left portions with respect to a center line of the narrow portion. The right and left portions are different in construction to adjust a balance of load between the right and left portions with respect to the center line.

14 Claims, 5 Drawing Sheets

WHITE KEY OF KEYBOARD INSTRUMENT

CROSS REFERENCE TO RELATED APPLICATION

The present application claims priority from Japanese Patent Application No. 2014-208134, which was filed on Oct. 9, 2014, the disclosure of which is herein incorporated by reference in its entirety.

BACKGROUND

Technical Field

The following disclosure relates to a white key of a keyboard instrument.

Description of the Related Art

Patent Document 1 (Japanese Patent Application Publication No. 2007-139885) discloses white and black keys each including: an upper wall elongated in a front and rear direction; and a pair of side walls extending downward respectively from right and left edges of the upper wall and each elongated in the front and rear direction, and the upper wall and the pair of side walls are formed of resin in one piece so as to have an inner space opening downward. In this example, the upper wall and the side walls have the same thickness.

Patent Document 2 (Japanese Unexamined Utility Model Application Publication No. 6-60887) discloses a white key including: an upper wall elongated in a front and rear direction; and a pair of side walls extending downward respectively from right and left edges of the upper wall and each elongated in the front and rear direction, and the upper wall and the pair of side walls are formed of resin in one piece. This white key includes: a narrow segment which is narrow in width in a lateral direction and formed with an inner space opening downward; and a wide segment which is wide in width in the lateral direction without having an inner space. In this white key, a gate for molding is provided in an intermediate portion of the narrow segment of one of the pair of side walls, whereby the thickness of the side wall not provided with the gate is greater than that of the side wall provided with the gate in the narrow segment. A hot molten resin material is poured into the narrow segment, and this resin material is cooled first in the side wall not provided with the gate and then cooled in the side wall provided with the gate. Thus, a larger amount of resin is poured into the side wall not provided with the gate than into the side wall provided with the gate, such that the side walls require the same amount of time for cooling and solidifying. This technique prevents the white key formed of resin from warping.

SUMMARY

The white keys and the black keys disclosed in Patent Document 1 suffer from the following problem. Since the black key is disposed between the adjacent white keys, each white key includes a narrow segment which is narrow in width in a lateral direction and a wide segment which is wide in width in the lateral direction, and a rear end portion of the narrow segment is supported by a key frame. The white key is not symmetric with respect to a center line extending through a center of the narrow segment in the widthwise direction. In other words, right and left portions of the white key with respect to the center line are not symmetrically formed. One of the right and left portions is greater than the other in area of an upper surface of the upper wall, so that the right and left portions have different weights. In each of the white keys respectively corresponding to notes C, E, F, and B, in particular, one of the side walls extends straight in the front and rear direction, but the other of the side walls has an inside corner portion. In the white key of this kind, accordingly, loads to be imposed on the respective right and left portions with respect to the center line are not balanced, and when depressed or released, the white key may vibrate and come into contact and collision with a key guide provided on the key frame for guiding the depression and release of the white key and/or with an adjacent one of the other white keys and the black keys, which may cause noises.

In the white key disclosed in Patent Document 2, the side wall not provided with the gate and the side wall provided with the gate are different from each other in thickness in the narrow segment. This construction is for preventing the warp of the white key by equalizing the time required for cooling and solidifying among the right and left portions. Thus, a difference in weight between the right and left portions with respect to the center line may be reduced or increased depending upon whether the gate is provided in one or the other of the pair of side walls. In the where the difference in weight between the right and left portions is large, depression and release of the white key cause greater vibration thereof than in the above-described case, so that greater noises are caused by the contact and collision of the white key with the key guide and/or an adjacent one of the other white keys and the black keys.

This invention has been developed in view of the above-described situations, and it is an object of the present invention to provide a white key of a keyboard instrument which reduces vibrations during depression or release of the white key.

The object indicated above may be achieved according to the present invention which provides a white key of a keyboard instrument. The white key includes: an upper wall elongated in a front and rear direction; and a pair of side walls extending downward respectively from right and left edges of the upper wall and each elongated in the front and rear direction. The upper wall and the pair of side walls define an inner space opening downward. The upper wall and the pair of side walls have a narrow portion and a wide portion that is greater than the narrow portion in width in a right and left direction. The white key has right and left portions located respectively to right and left of a center line of the narrow portion in the right and left direction. A one-side portion as one of the right and left portions and an other-side portion as another of the right and left portions are different from each other in construction to adjust a balance of load between the right and left portions with respect to the center line.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Construction of Keyboard of Keyboard Instrument

Figure 1:
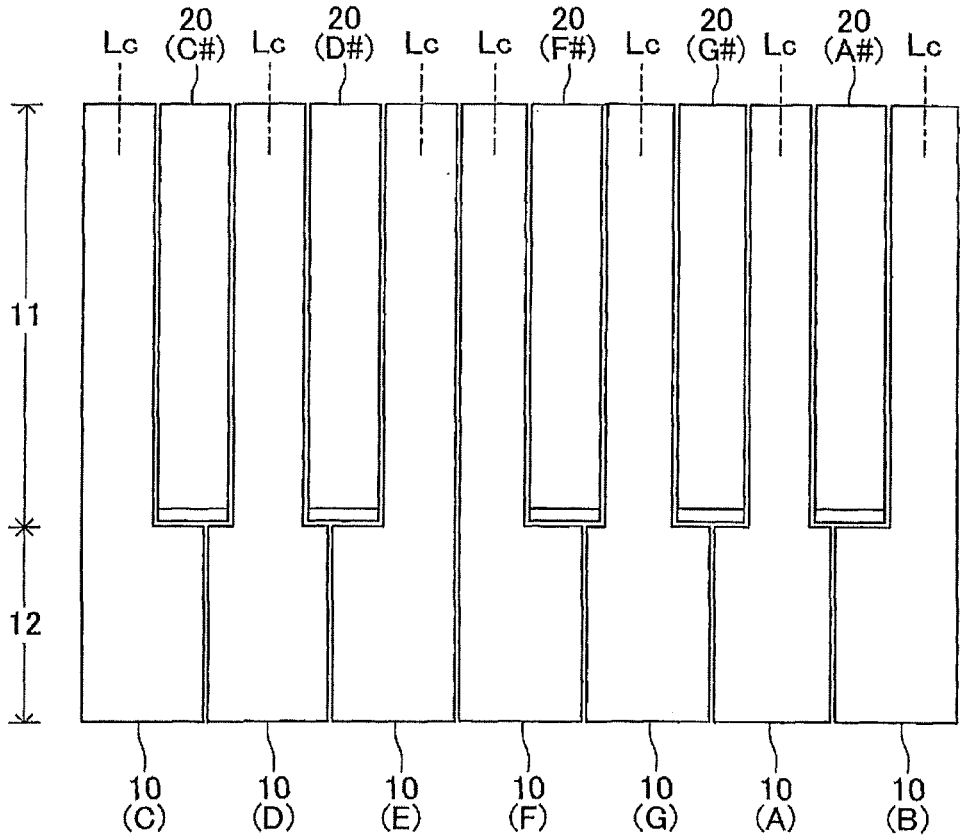
FIG. 1 is a plan view illustrating one example of a construction of a keyboard of a keyboard instrument.

First, there will be described a construction of a keyboard of a keyboard musical instrument by reference to the drawings. FIG. 1 is a plan view illustrating an arrangement of keys of the keyboard which correspond to one octave. In the following explanation, the right and left direction in FIG. 1 is defined as the right and left direction (i.e., the lateral direction) of the keyboard, the lower side in FIG. 1 as the front side of the keyboard, and the upper side in FIG. 1 as the rear side of the keyboard.

The keyboard includes seven white keys 10 and five black keys 20 arranged in the lateral direction. The seven white keys 10 respectively correspond to notes C, D, E, F, U, A, and B, and the five black keys 20 respectively correspond to notes C#, D#, F#, G#, and A#. The black key 20 corresponding to C# is disposed between the two adjacent white keys 10 respectively corresponding to C and D. The black key 20 corresponding to D# is disposed between the two adjacent white keys 10 respectively corresponding to D and E. The black key 20 corresponding to F# is disposed between the two adjacent white keys 10 respectively corresponding to F and G The black key 20 corresponding to G# is disposed between the two adjacent white keys 10 respectively corresponding to G and A. The black key 20 corresponding to A# is disposed between the two adjacent white keys 10 respectively corresponding to A and B.

Each of the white keys 10 has a three-sided rectangular shape opening downward in vertical cross section and includes an upper wall, right and left side walls, and a front wall which will be explained below in detail. Likewise, each of the black keys 20 has a three-sided rectangular shape opening downward in vertical cross section and includes an upper wall, right and left side walls, and a front wall. The black key 20 is elongated in the front and rear direction so as to have a constant width. The white key 10 has an inside corner portion (a stepped portion) slightly in front of a front end of the black key 20. The white key 10 has a narrow segment 11 at the rear of the inside corner portion, and this narrow segment 11 has a width less than a predetermined length in the lateral direction. The white key 10 further has a wide segment 12 in front of the inside corner portion, and this wide segment 12 has a width greater than that of the narrow segment 11 in the lateral direction. The respective narrow segments 11 of all the white keys 10 have the same width that is equal to that of each black key 20 in the lateral direction. The respective wide segments 12 of all the white keys 10 have the same width in the lateral direction. It is noted that the widths of the respective narrow segments 11 of all the white keys 10 may not be equal to each other and may be different from each other according to the kind of the white keys 10.

In each of the two white keys 10 respectively corresponding to C and F, the left side wall extends straight in the front and rear direction, and the right side wall is provided with a large inside corner portion. In each of the two white keys 10 respectively corresponding to E and B, the right side wall extends straight in the front and rear direction, and the left side wall is provided with a large inside corner portion. In each of the three white keys 10 respectively corresponding to D, G, and A, each of the right and left side walls is provided with a relatively small inside corner portion. Thus, in each of the four white keys 10 respectively corresponding to C, E, F, and B, one of right and left portions of the white key 10, which are located to the right and left of a line (a center line Lc) extending through a center of the narrow segment 11 in the widthwise direction, is larger than the other in area of an upper surface of a corresponding portion of the upper wall, so that the right and left portions greatly differ from each other in weight. Also, in each of the three white keys 10 respectively corresponding to D, G, and A, the widths of the respective right and left inside corner portions are different from each other in the lateral direction, and accordingly one of right and left portions of the white key 10 with respect to the center line Lc is larger than the other in area of an upper surface of a corresponding portion of the upper wall, so that the right and left portions differ from each other in weight. In each of the three white keys 10 respectively corresponding to D, G, and A, however, the difference in width between the right and left inside corner portions is relatively small, and a difference in weight between the right and left portions is not large. In the following description, the one of the right and left portions of each white key 10 may be referred to as "the one-side portion", and the other as "the other-side portion". It is noted that the one-side portion is a portion of the white key 10 which is located to one of the right and left of the center line Lc extending through the center of the narrow segment 11 in the widthwise direction when the upper surface of the upper wall of the white key 10 is viewed from an upper side thereof (right above), and the other-side portion is a portion of the white key 10 which is located to the other of the right and left of the center line Lc when the upper surface of the upper wall of the white key 10 is viewed from an upper side thereof (right above).

Each of the white keys 10 and the black keys 20 is pivotably supported at rear end portions of the right and left side walls by a key support of a key frame, not shown, such that a front end portion of each key is movable in the up and down direction. Each key support includes: a pair of plate members provided upright so as to respectively face inner surfaces of a corresponding one of the white key 10 and the black key 20; and protrusions protruding to outsides of the respective plate members. Rear end portions of the respective right and left side walls of each of the white key 10 and the black key 20 have through holes through which the respective protrusions extend outward such that the protrusions are slidable in the respective holes. A spring is provided between the key frame and a lower surface of each of the white keys 10 and the black keys 20 so as to urge a front end portion of each of the white key 10 and the black key 20 upward. This vertical movement of the front end portion of each of the white key 10 and the black key 20 is limited by a stopper provided on the key frame. Thus, when depressed or released, the front end portion of each of the white key 10 and the black key 20 is moved in the up and down direction within a space defined by the limitation. Key guides are provided on the key frame and under the white keys 10 and the black keys 20. During depression or release of each of the white key 10 and the black key 20, a corresponding one of the key guides contacts a portion of the key to guide upward and downward movement of the key. That is, each key guide limits movement of a corresponding one of the white key 10 and the black key 20 in the right and left direction during depression or release of the key.

First Embodiment

Figure 2A:
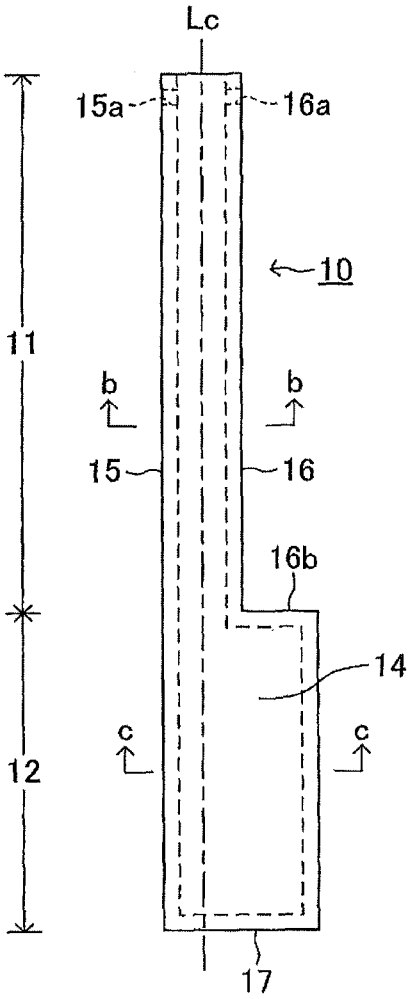
FIG. 2A is a plan view illustrating a white key according to a first embodiment.
Figure 2B:
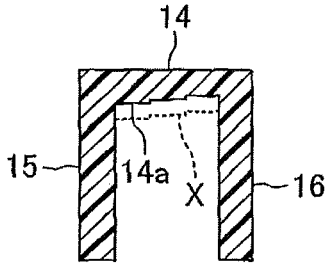
FIG. 2B is a cross-sectional view taken along line b-b in FIG. 2A.
Figure 2C:
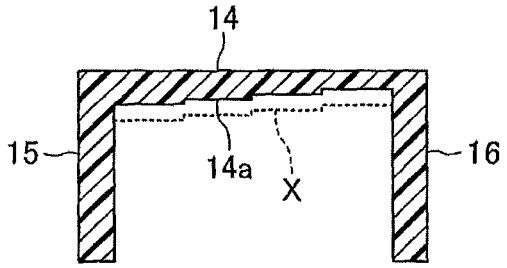
FIG. 2C is a cross-sectional view taken along line c-c in FIG. 2A.

There will be next explained white keys 10 according to a first embodiment of the present invention with reference to FIGS. 2A-2C. FIG. 2A is a plan view illustrating the white keys 10 respectively corresponding to C and F, in each of which the difference in weight between the right and left portions of the white key 10 with respect to the center line Lc is large. FIG. 2B is a cross-sectional view taken along line b-b in FIG. 2A, and FIG. 2C is a cross-sectional view taken along line c-c in FIG. 2A.

Each white key 10 includes an upper wall 14, a left side wall 15, a right side wall 16, and a front wall 17 and is formed with an inner space having a square shape opening downward. These upper wall 14, the left side wall 15, the right side wall 16, and the front wall 17 are formed of resin and molded in one piece so as to each have a planar plate shape. The respective rear end portions of the left side wall 15 and the right side wall 16 have through holes 15*a*, 16*a* through which the protrusions of the key support provided on the key frame extend. In each of the white keys 10, the right side wall 16 has an inside corner portion 16*b*, and a portion of the white key 10 at the rear of the inside corner portion 16*b* is defined as the narrow segment 11, and a portion of the white key 10 in front of the inside corner portion 16*b* is defined as the wide segment 12.

The left side wall 15, the right side wall 16, and the front wall 17 have the same thickness, but the thickness of the upper wall 14 varies in the right and left direction. Specifically, the thickness of a left edge portion of the upper wall 14 is equal to that of each of the left side wall 15, the right side wall 16, and the front wall 17, and an inside surface 14*a* of the upper wall 14 is stepped such that the thickness of the upper wall 14 decreases stepwise toward the right side over the entire area of the upper wall 14 in the front and rear direction, i.e., over an area on the upper wall 14 from its front end to rear end. It is noted that an upper surface of the upper wall 14 is flat, and the upper wall 14 has the same thickness at the same position in the right and left direction. As a result, the weight of the upper wall 14 gradually decreases rightward.

Instead of the upper wall 14, as indicated by the broken line X in FIGS. 2B and 2C, the white key 10 may be constructed such that the thickness of a right edge portion of the upper wall 14 (i.e., a right edge portion of the wide segment 12) is equal to that of each of the left side wall 15, the right side wall 16, and the front wall 17, and the inside surface 14*a* of the upper wall 14 is stepped such that the thickness of the upper wall 14 increases stepwise toward the left side over the entire area of the upper wall 14 in the front and rear direction, i.e., over an area on the upper wall 14 from its front end to rear end. Also in this construction, the weight of the upper wall 14 gradually decreases rightward.

As long as the white key 10 is constructed such that the weight of the upper wall 14 gradually decreases rightward even though the thickness of the right or left edge portion of the upper wall 14 is not equal to that of each of the left side wall 15, the right side wall 16, and the front wall 17, the thickness of the right or left edge portion of the upper wall 14 is not limited and may be greater or less than the thickness of each of the left side wall 15, the right side wall 16, and the front wall 17. The number of steps of the upper wall 14 is not limited and may be any number for changing the thickness. For example, two steps may be formed such that the left portion with respect to the center line Lc is thicker than the right portion with respect to the center line Lc. Instead of changing the thickness of the upper wall 14 stepwise, the inside surface 14*a* of the upper wall 14 may continuously incline in the right and left direction such that the left portion is thicker than the right portion with respect to the center line Lc. That is, in the construction in which the left side wall 15 (as one example of a second side wall) has no inside corner portion, and the right side wall 16 (as one example of a first side wall) has the inside corner portion 16*b*, the upper wall 14 at least needs to be formed such that the thickness of the upper wall 14 near the left side wall 15 (i.e., a portion of the upper wall 14 near the left side wall 15) is greater than the upper wall 14 near the right side wall 16 (i.e., a portion of the upper wall 14 near the right side wall 16).

The thickness of the upper wall 14 is made different in the right and left direction such that the weight of the left portion of the white key 10 with respect to the center line Lc is substantially equal to the weight of the right portion of the white key 10 with respect to the center line Lc. That is, loads to be imposed on the respective right and left portions of the white key 10 with respect to the center line Lc are balanced with each other. Accordingly, when the white key 10 is depressed or released, an amount of vibrations of the white key 10 is reduced, and the white key 10 is prevented from coming into contact and collision with the key guide for the white key 10 and/or with an adjacent one of the other white keys 10 and the black keys 20, resulting in no noise. It is noted that although the weight of the left portion of the white key 10 with respect to the center line Lc is preferably substantially equal to the weight of the right portion of the white key 10 with respect to the center line Lc, the effects can be obtained when the weights are substantially equal to each other, without being precisely equal to each other. In other words, the balance of load between the right and left portions at least needs to be adjusted such that the loads to be imposed on the right and left portions with respect to the center line Lc are completely or substantially balanced with each other. This condition applies to the adjustments of the weight and the balance of load which will be described below.

In the first embodiment and its modifications, the thickness of the upper wall 14 in the right and left direction varies over the entire area of the upper wall 14 in the front and rear direction. However, the white key 10 may be constructed such that the thickness of the upper wall 14 in the right and left direction varies only in a portion of the upper wall 14 in the front and rear direction, and the thickness of the upper wall 14 in the right and left direction is uniform in the other portion of the upper wall 14 in the front and rear direction. This uniform thickness is, for example, equal to the thickness of each of the left side wall 15, the right side wall 16, and the front wall 17. In particular, the weight of the left portion of the white key 10 with respect to the center line Lc may be made precisely or substantially equal to the weight of the right portion of the white key 10 with respect to the center line Lc by a construction in which the thickness of the upper wall 14 in the right and left direction is uniform in the narrow segment 11 and varies only in the wide segment 12. Also in this construction, the thickness of the upper wall 14 in the right and left direction may vary not in the entire area of the wide segment 12 in the front and rear direction but in only a portion of the entire area.

In the case where the thickness of the upper wall 14 in the right and left direction varies only in the wide segment 12, the following effects can also be obtained. In the white key 10, at a position far from a fulcrum position in the rear end portion of the narrow segment 11, increase in difference in weight between the right and left portions of the white key 10 which are respectively located to the right and left of the center line Lc increases a possibility of occurrence of vibrations and warps in the white key 10 when the white key 10 is depressed or released. Thus, in the case where the balance of load between the right and left portions is adjusted such that the loads to be imposed on the right and left portions with respect to the center line Lc are completely or substantially balanced with each other by the construction in which the thickness of the upper wall 14 in the right and left direction varies only in the wide segment 12, and the weight of the left portion of the white key 10 with respect to the center line Lc is precisely or substantially equal to the weight of the right portion of the white key 10 with respect to the center line Lc, it is possible to reduce the vibrations and the warps of the white key 10.

Second Embodiment

Figure 3A:
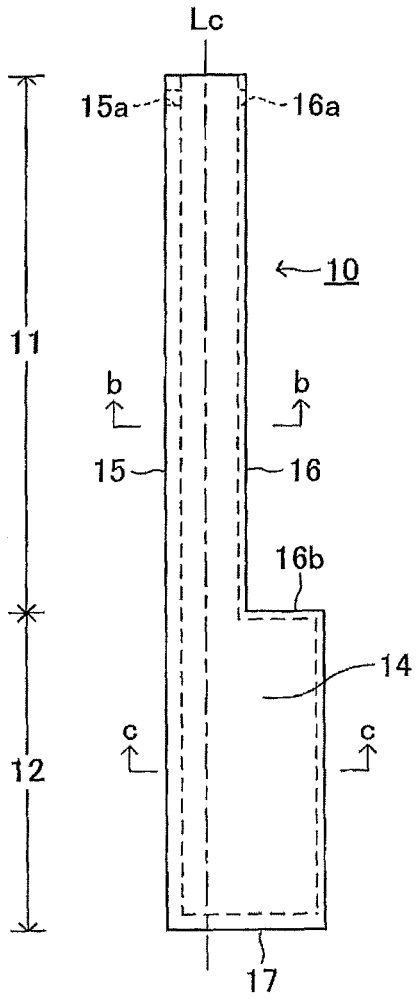
FIG. 3A is a plan view illustrating a white key according to a second embodiment.
Figure 3B:
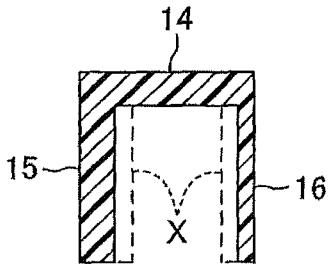
FIG. 3B is a cross-sectional view taken along line b-b in FIG. 3A.
Figure 3C:
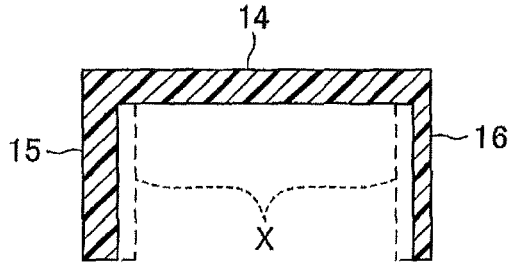
FIG. 3C is a cross-sectional view taken along line c-c in FIG. 3A.

There will be next explained white keys 10 according to a second embodiment with reference to FIGS. 3A-3C. As in the first embodiment, FIG. 3A is a plan view illustrating the white keys 10 respectively corresponding to C and E FIG. 3B is a cross-sectional view taken along line b-b in FIG. 3A, and FIG. 3C is a cross-sectional view taken along line c-c in FIG. 3A. This second embodiment and the first embodiment are different from each other only in the thicknesses of the upper wall 14, the left side wall 15, and the right side wall 16 and are the same as each other in the other construction. Thus, the same reference numerals as used in the first embodiment are used to designate the corresponding elements of the second embodiment, and an explanation of which is dispensed with.

In this second embodiment, the upper wall 14 and the front wall 17 have the same thickness, but the thickness of the left side wall 15 differs from that of the right side wall 16. Specifically, the thickness of the left side wall 15 is equal to that of the upper wall 14 and the front wall 17. An inside portion of the right side wall 16 is reduced to make the thickness of the right side wall 16 less than that of the left side wall 15 over the entire area of the right side wall 16 in the front and rear direction, i.e., over an area of the right side wall 16 from its front end to rear end. It is noted that each of the left side wall 15 and the right side wall 16 has the uniform thickness. Accordingly, the weight of the left side wall 15 is greater than that of the right side wall 16.

Instead of the left side wall 15 and the right side wall 16, as indicated by the broken lines X in FIGS. 3B and 3C, an inside portion surface of the left side wall 15 may be increased to make the thickness of the left side wall 15 greater than that of the right side wall 16 over the entire area of the left side wall 15 in the front and rear direction, i.e., over the area of the left side wall 15 from its front end to rear end. The thickness of the right side wall 16 is equal to that of the upper wall 14 and the front wall 17. Also in this case, each of the left side wall 15 and the right side wall 16 has the uniform thickness. Accordingly, the weight of the left side wall 15 is greater than that of the right side wall 16.

In the embodiment, the thickness of the left side wall 15 or the right side wall 16 is equal to that of the upper wall 14 and the front wall 17. The thickness of the left side wall 15 or the right side wall 16 may not be equal to that of the upper wall 14 and the front wall 17 as long as the thickness of the left side wall 15 is greater than that of the right side wall 16.

Also, the thickness of the left side wall 15 and the thickness of the right side wall 16 at least need to be different from each other such that the weight of the left portion of the white key 10 with respect to the center line Lc is precisely or substantially equal to the weight of the right portion of the white key 10 with respect to the center line Lc. Thus, the balance of load between the right and left portions is adjusted also in this white key 10 such that the loads to be imposed on the right and left portions with respect to the center line Lc are completely or substantially balanced with each other. Accordingly, when the white key 10 is depressed or released, an amount of vibrations of the white key 10 is reduced, and the white key 10 is prevented from coming into contact and collision with the key guide for the white key 10 and/or with an adjacent one of the other white keys 10 and the black keys 20, resulting in no noise.

In the second embodiment and its modifications, the thickness of the entire left side wall 15 differs from that of the entire right side wall 16 over the enter area of the left side wall 15 and the right side wall 16 in the front and rear direction. However, the white key 10 may be constructed such that the thickness of the left side wall 15 differs from that of the right side wall 16 only in a portion of the left side wall 15 and the right side wall 16 in the front and rear direction, and the thickness of the other portion of the left side wall 15 and the right side wall 16 in the front and rear direction is equal to the thickness of the upper wall 14 and the front wall 17. In particular, the white key 10 may be constructed such that the thickness of the left side wall 15 is equal to that of the right side wall 16 in the narrow segment 11, and the thickness of the left side wall 15 differs from that of the right side wall 16 only in the wide segment 12 in the state in which the weight of the left portion of the white key 10 with respect to the center line Lc is precisely or substantially equal to the weight of the right portion of the white key 10 with respect to the center line Lc. Also in this case, the thickness of the left side wall 15 and the thickness of the right side wall 16 may differ from each other not in the entire area of the wide segment 12 in the front and rear direction but only in a portion of the wide segment 12 in the front and rear direction. That is, in the construction in which the left side wall 15 has no inside corner portion, and the right side wall 16 has the inside corner portion 16*b*, the left side wall 15 and the right side wall 16 at least need to be formed such that the thickness of the left side wall 15 is greater than that of the right side wall 16.

In the case where the thickness of the left side wall 15 differs from that of the right side wall 16 only in the wide segment 12, it is possible to further reduce the vibrations and the warps of the white key 10 for the reasons explained in the modification of the first embodiment.

Third Embodiment

Figure 4A:
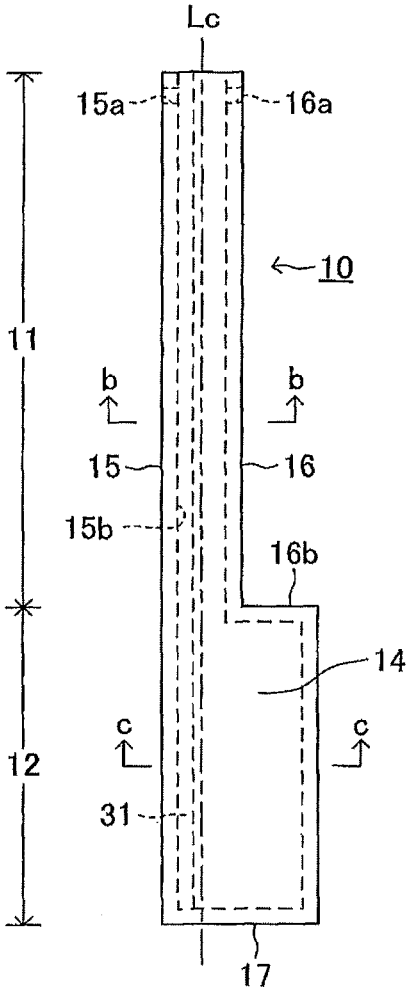
FIG. 4A is a plan view illustrating a white key according to a third embodiment.
Figure 4B:
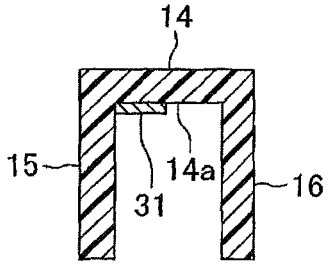
FIG. 4B is a cross-sectional view taken along line b-b in FIG. 4A.
Figure 4C:
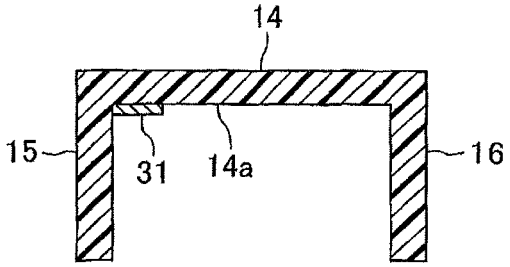
FIG. 4C is a cross-sectional view taken along line c-c in FIG. 4A.

There will be next explained white keys 10 according to a third embodiment with reference to FIGS. 4A-4D. As in the first and second embodiments, FIG. 4A is a plan view illustrating the white keys 10 respectively corresponding to C and F. FIG. 4B is a cross-sectional view taken along line b-b in FIG. 4A, and FIG. 4C is a cross-sectional view taken along line c-c in FIG. 4A. This third embodiment is principally the same as the first and second embodiments in construction. Thus, the same reference numerals as used in the first and second embodiments are used to designate the corresponding elements of the third embodiment, and an explanation of which is dispensed with.

In this third embodiment, the upper wall 14, the left side wall 15, the right side wall 16, and the front wall 17 have the same thickness. A weight 31 elongated in the front and rear direction is bonded and fixed by adhesive to a left edge portion of the inside surface 14*a* of the upper wall 14 (i.e., a portion of the inside surface 14*a* which is located to the left of the center line Lc) over the entire area of the upper wall 14 in the front and rear direction, i.e., over an area on the upper wall 14 from its front end to rear end. This weight 31 is constituted by a thin metal film, for example.

The weight of the weight 31 is determined such that the weight of the left portion of the white key 10 with respect to the center line Lc is precisely or substantially equal to the weight of the right portion of the white key 10 with respect to the center line Lc. Thus, the balance of load between the right and left portions is adjusted also in this white key 10 such that the loads to be imposed on the right and left portions with respect to the center line Lc are completely or substantially balanced with each other. Accordingly, when the white key 10 is depressed or released, an amount of vibrations of the white key 10 is reduced, and the white key 10 is prevented from coming into contact and collision with the key guide for the white key 10 and/or with an adjacent one of the other white keys 10 and the black keys 20, resulting in no noise.

Figure 4D:
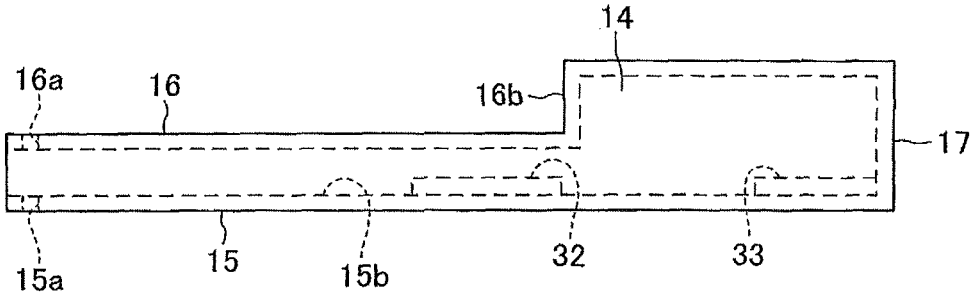
FIG. 4D is a plan view illustrating a white key according to a modification of the third embodiment.

In the third embodiment, the weight 31 is fixed to the inside surface 14*a* of the upper wall 14 continuously over the entire area of the upper wall 14 in the front and rear direction. Instead of this construction, as illustrated in FIG. 4D, a weight 32 or a weight 33 may be bonded and fixed to only a portion of the left edge portion of the inside surface 14*a* of the upper wall 14 (i.e., the portion of the inside surface 14*a* which is located to the left of the center line Lc). That is, the weight 32 or the weight 33 may be bonded and fixed to only the portion of the upper wall 14 in the front and rear direction. Also in this case, the weight of the left portion of the white key 10 with respect to the center line Lc needs to be made precisely or substantially equal to the weight of the right portion of the white key 10 with respect to the center line Lc. Thus, a metal member having a thickness greater than that of the weight 31 in the third embodiment is used for the weight 32 or the weight 33. That is, in the construction in which the left side wall 15 has no inside corner portion, and the right side wall 16 has the inside corner portion 16*b*, the upper wall 14 at least needs to be formed such that the weight is bonded to a portion of the inside surface 14*a* of the upper wall 14 near the left side wall 15, and no weight is bonded to a portion of the inside surface 14*a* of the upper wall 14 near the right side wall 16. In the case where the weight 33 is provided on the left edge portion of the inside surface 14*a* of the upper wall 14 in the entire area of the wide segment 12 or only in a portion of the wide segment 12 in the front and rear direction, it is possible to reduce the vibrations and the warps of the white key 10 for the reasons explained in the modification of the first embodiment.

In the third embodiment and its modification, the weight 31, 32, or 33 is bonded and fixed to the left edge portion of the inside surface 14*a* of the upper wall 14. However, the weight 31, 32, or 33 at least needs to be secured to the left edge portion of the inside surface 14*a* of the upper wall 14. For example, the white key 10 may be constructed such that a protrusion is provided on the inside surface 14*a* of the upper wall 14, and a hole is formed in the weight 31, 32, or 33, and the protrusion is fitted in the hole to secure the weight 31, 32, or 33 to the left edge portion of the inside surface 14*a* of the upper wall 14. Conversely, the white key 10 may be constructed such that a hole is formed in the upper wall 14, and a protrusion is provided on the weight 31, 32, or 33, and the protrusion is fitted in the hole to secure the weight 31, 32, or 33 to the left edge portion of the inside surface 14*a* of the upper wall 14. Furthermore, the weight 31, 32, or 33 may be secured to the left edge portion of the inside surface 14*a* of the upper wall 14 by a securing member such as a screw.

Fourth Embodiment

Figure 5A:
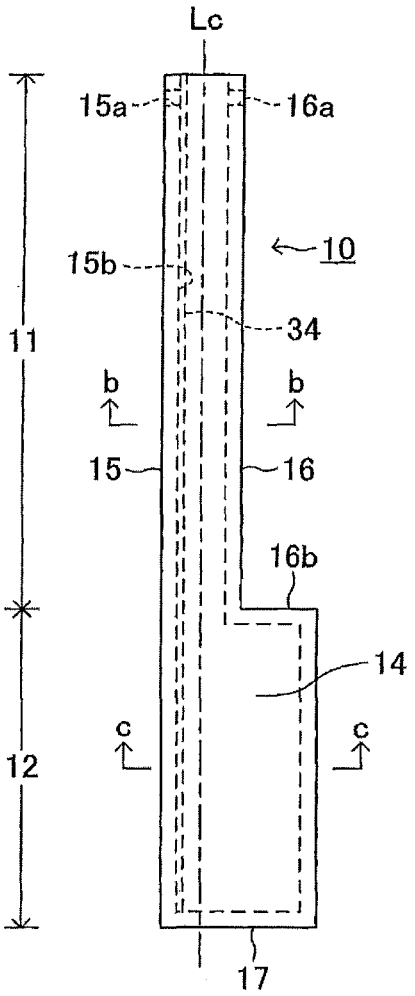
FIG. 5A is a plan view illustrating a white key according to a fourth embodiment.
Figure 5B:
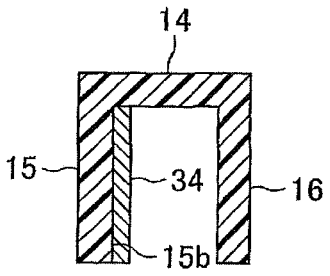
FIG. 5B is a cross-sectional view taken along line b-b in FIG. 5A.
Figure 5C:
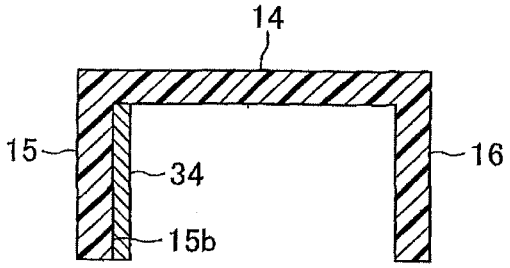
FIG. 5C is a cross-sectional view taken along line c-c in FIG. 5A.

There will be next explained white keys 10 according to a fourth embodiment with reference to FIGS. 5A-5D. As in the first, second, and third embodiments, FIG. 5A is a plan view illustrating the white keys 10 respectively corresponding to C and E FIG. 5B is a cross-sectional view taken along line b-b in FIG. 5A, and FIG. 5C is a cross-sectional view taken along line c-c in FIG. 5A. This fourth embodiment is principally the same as the first, second, and third embodiments in construction. Thus, the same reference numerals as used in the first, second, and third embodiments are used to designate the corresponding elements of the fourth embodiment, and an explanation of which is dispensed with.

In this fourth embodiment, as in the third embodiment, the upper wall 14, the left side wall 15, the right side wall 16, and the front wall 17 have the same thickness. While the weight 31 is provided on the left edge portion of the inside surface 14*a* of the upper wall 14 in the third embodiment, a weight 34 elongated in the front and rear direction is bonded and fixed by adhesive to an inside surface 15*b* of the left side wall 15 over the entire area of the left side wall 15 in the front and rear direction, i.e., over the area of the left side wall 15 from its front end to rear end in the fourth embodiment. As in the third embodiment, this weight 34 is also constituted by a thin metal film, for example. That is, in the construction in which the left side wall 15 has no inside corner portion, and the right side wall 16 has the inside corner portion 16*b*, the left side wall 15 and the right side wall 16 at least need to be formed such that a weight is bonded to the inside surface 15*b* of the left side wall 15, and no weight is bonded to the inside surface of the right side wall 16.

The weight of the weight 34 is determined also in this case such that the weight of the left portion of the white key 10 with respect to the center line Lc is precisely or substantially equal to the weight of the right portion of the white key 10 with respect to the center line Lc. Thus, the balance of load between the right and left portions is adjusted also in this white key 10 such that the loads to be imposed on the right and left portions with respect to the center line Lc are completely or substantially balanced with each other. Accordingly, when the white key 10 is depressed or released, an amount of vibrations of the white key 10 is reduced, and the white key 10 is prevented from coming into contact and collision with the key guide for the white key 10 and/or with an adjacent one of the other white keys 10 and the black keys 20, resulting in no noise.

Figure 5D:
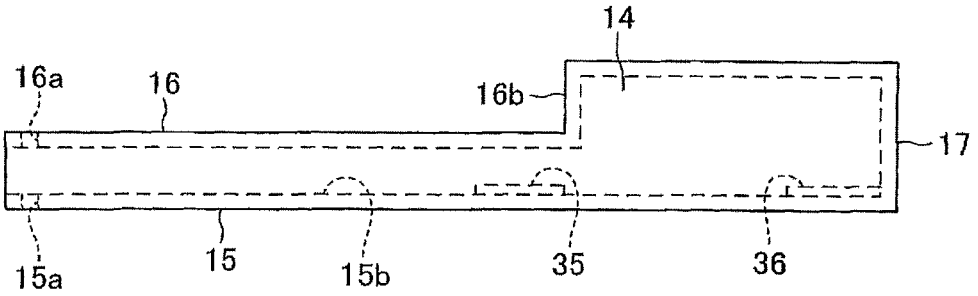
FIG. 5D is a plan view illustrating a white key according to a modification of the fourth embodiment.

In the fourth embodiment, the weight 34 is continuously fixed to the entire area of the left side wall 15 in the front and rear direction. Instead of this construction, as illustrated in FIG. 5D, a weight 35 or a weight 36 may be fixed to only a portion of the inside surface 15*b* of the left side wall 15. That is, the weight 35 or the weight 36 may be fixed to only the portion of the left side wall 15 in the front and rear direction. Also in this case, the weight of the left portion of the white key 10 with respect to the center line Lc needs to be made precisely or substantially equal to the weight of the right portion of the white key 10 with respect to the center line Lc. Thus, a metal member having a thickness greater than that of the weight 34 in the fourth embodiment is used for the weight 35 or the weight 36. In the case where the weight 36 is provided on the inside surface 15*b* of the left side wall 15 in the entire area of the wide segment 12 or only in a portion of the wide segment 12 in the front and rear direction, it is possible to reduce the vibrations and the warps of the white key 10 for the reasons explained in the modification of the first embodiment.

In the fourth embodiment and its modification, the weight 34, 35, or 36 is bonded and fixed to the inside surface 15*b* of the left side wall 15. Also in this case, however, the weight 34, 35, or 36 at least needs to be secured to the inside surface 15*b* of the left side wall 15. For example, the white key 10 may be constructed such that a protrusion is provided on the inside surface 15*b* of the left side wall 15, and a hole is formed in the weight 34, 35, or 36, and the protrusion is fitted in the hole to secure the weight 34, 35, or 36 to the inside surface 15*b* of the left side wall 15. Conversely, the white key 10 may be constructed such that a hole is formed in the left side wall 15, and a protrusion is provided on the weight 34, 35, or 36, and the protrusion is fitted in the hole to secure the weight 34, 35, or 36 to the inside surface 15*b* of the left side wall 15. Furthermore, the weight 34, 35, or 36 may be secured to the inside surface 15*b* of the left side wall 15 by a securing member such as a screw.

OTHER MODIFICATIONS

While the embodiments and modifications have been described above, it is to be understood that the disclosure is not limited to the details of the illustrated embodiments and modifications, but may be embodied with various changes and other modifications, which may occur to those skilled in the art, without departing from the spirit and scope of the disclosure.

In the first through fourth embodiments, the present invention is applied to the white keys 10 respectively corresponding to C and F, in each of which the difference in weight between the right and left portions of the white key 10 with respect to the center line Lc is large. However, the present invention may be applied to the white keys 10 respectively corresponding to E and B, in each of which the difference in weight between the right and left portions of the white key 10 with respect to the center line Lc is large. In this case, the weight of the left portion of the white key 10 with respect to the center line Lc is greater than that of the right portion of the white key 10 with respect to the center line Lc. Thus, in the case of the first embodiment and its modifications, the white key 10 is constructed such that the thickness of the entirety or a portion of the upper wall 14 varies such that the thickness of the upper wall 14 in the right portion with respect to the center line Lc is greater than that of the upper wall 14 in the left portion with respect to the center line Lc. In the case of the second embodiment and its modifications, the thickness of the entirety or a portion of the right side wall 16 is made greater than that of the left side wall 15. In the case of the third embodiment and its modifications, the weight 31, 32, or 33 is bonded to the entirety or a portion of a right edge portion of the inside surface 14*a* of the upper wall 14 (i.e., a right portion of the inside surface 14*a* with respect to the center line Lc). In the case of the fourth embodiment and its modifications, the weight 34, 35, or 36 is bonded to the entirety or a portion of the inside surface of the right side wall 16.

The present invention may also be applied to the white keys 10 corresponding to D, G, and A, in each of which the difference in weight between the right and left portions of the white key 10 with respect to the center line Lc is not large. Also in the case of these white keys 10, the white key 10 is constructed such that the thickness of the upper wall 14 varies in the right and left direction, the thickness of the left side wall 15 differs from that of the right side wall 16, the weight 31, 32, or 33 is fixed to the inside surface 14*a* of the upper wall 14, or the weight 33, 34, or 35 is fixed to the inside surface of the left side wall 15 or the right side wall 16, such that the weights of the right and left portions with respect to the center line Lc are precisely or substantially equal to each other. In the case where the left side wall of the white key 10 has a narrow inside corner portion, and the right side wall of the white key 10 has an inside corner portion wider than the inside corner portion formed in the left side wall in the white keys 10 respectively corresponding to D, G, and A, for example, the upper wall 14 at least needs to be formed such that the thickness of a portion of the upper wall 14 nearer to the left side wall is greater than that of a portion of the upper wall 14 nearer to the right side wall. In the second embodiment, the side walls at least need to be formed such that the thickness of the left side wall 15 is greater than that of the right side wall 16. In the third embodiment, the weight 31 at least needs to be not provided on the portion of the upper wall 14 near the right side wall 16 but provided on the inside surface of the upper wall 14 near the left side wall 15. In the fourth embodiment, the weight at least needs to be not provided on the inside surface of the right side wall 16 but provided on the inside surface the left side wall 15. In these cases, however, the difference in weight between the right and left portions of the white key 10 with respect to the center line Lc is not large. Thus, an amount of variation in thickness of the upper wall 14 in the right and left direction, the difference in thickness between the left side wall 15 and the right side wall 16, or the weight of the weight 31, 32, or 33 or the weight 33, 34, or 35 is made less than in the case of the white keys respectively corresponding to C, E, F, and B.

In the first embodiment and its modifications, the thickness of the upper wall 14 varies in the right and left direction to adjust the balance of load between the right and left portions of the white key 10 such that the loads to be imposed on the right and left portions with respect to the center line Lc are completely or substantially balanced with each other. In the second embodiment and its modifications, the difference in weight is provided between the left side wall 15 and the right side wall 16 to adjust the balance of load between the right and left portions of the white key 10 such that the loads to be imposed on the right and left portions with respect to the center line Lc are completely or substantially balanced with each other. In the third embodiment and its modifications, the weight 31, 32, or 33 is bonded to the inside surface 14*a* of the upper wall 14 to adjust the balance of load between the right and left portions of the white key 10 such that the loads to be imposed on the right and left portions with respect to the center line Lc are completely or substantially balanced with each other. In the fourth embodiment and its modifications, the weight 34, 35, or 36 is bonded to the inside surface 15*b* of the left side wall 15 to adjust the balance of load between the right and left portions of the white key 10 such that the loads to be imposed on the right and left portions with respect to the center line Lc are completely or substantially balanced with each other. However, the white key 10 may be constituted by combining two or more of the techniques in the first through fourth embodiments.

In the first through fourth embodiments and their modifications, the keyboard is constructed such that the protrusions of the key support extend through the respective through holes 15*a*, 16*a* formed in the rear end portions of the left side wall 15 and the right side wall 16, whereby the white key 10 is pivotably supported by the key frame. It is noted that the black keys 20 are pivotably supported in the same manner. However, the present invention may be applied to a keyboard device constructed such that each of the white keys 10 and the black keys 20 is pivotably supported by a hinge. Specifically, an elastically deformable hinge formed of resin and having a thin planar plate shape is formed integrally with a rear end face of each of the white keys 10 and the black keys 20. The key frame supports a rear end of each hinge.

In this modification, the keyboard including the white keys 10 and the black keys 20 preferably has the following construction. The four white keys 10 respectively corresponding to C, E, G, and B and not adjacent to each other are formed integrally with each other as a first key unit. The three white keys 10 respectively corresponding to D, F, and A and not adjacent to each other are formed integrally with each other as a second key unit. The five black keys 20 respectively corresponding to C#, D#, F#, G#, and A# and not adjacent to each other are formed integrally with each other as a third key unit. Hinges are respectively provided on the white keys 10 and the black keys 20 so as to extend rearward. Connectors extending in the lateral direction are provided for the respective first, second, and third key units. In each of the first, second, and third key units, rear ends of the respective hinges are connected to each other with a corresponding one of the connectors. A supporter is provided on the key frame so as to extend in the lateral direction, and the connectors for the respective key units are superposed on the supported, and thereafter the first, second, and third key units are fixed to the key frame using screws, for example. With this construction, the white keys 10 to which the present invention is applied can be easily assembled to the key frame.

What is claimed is:

1. A white key of a keyboard instrument, the white key comprising:

an upper wall elongated in a front and rear direction; and a pair of side walls extending downward respectively from right and left edges of the upper wall and each elongated in the front and rear direction, the upper wall and the pair of side walls defining an inner space opening downward, the upper wall and the pair of side walls comprising a narrow portion and a wide portion that is greater than the narrow portion in width in a right and left direction, the white key comprising right and left portions located respectively to right and left of a center line of the narrow portion in the right and left direction, a one-side portion as one of the right and left portions and an other-side portion as another of the right and left portions being different from each other in construction to adjust a balance of load between the right and left portions with respect to the center line.

2. The white key according to claim 1, wherein a thickness of a portion or an entirety of the upper wall in the one-side portion is greater than a thickness of the upper wall in the other-side portion, or a thickness of a portion or an entirety of one of the pair of side walls in the one-side portion is greater than a thickness of another of the pair of side walls in the other-side portion.

3. The white key according to claim 1, wherein a weight is secured to a portion or an entirety of an inside surface of the upper wall in the one-side portion, or a weight is secured to a portion or an entirety of an inside surface of one of the pair of side walls in the one-side portion.

4. The white key according to claim 1, wherein the one-side portion and the other-side portion are different from each other in construction in the wide portion.

5. The white key according to claim 2, wherein at least one of the pair of side walls comprises an inside corner portion which divides the at least one side wall into a front side wall and a rear side wall in the front and rear direction, wherein the narrow portion is located at a rear of the inside corner portion of the white key, and wherein the wide portion is located in front of the inside corner portion of the white key.

6. The white key according to claim 5, wherein the pair of side walls comprise a one-side wall in the one-side portion and an other-side wall in the other-side portion, wherein the inside corner portion is formed in the other-side wall and is not formed in the one-side wall, and wherein a thickness of a portion or an entirety of a portion of the upper wall which is nearer to the one-side wall than to the other-side wall is greater than that of a portion or an entirety of a portion of the upper wall which is nearer to the other-side wall than to the one-side wall.

7. The white key according to claim 5, wherein the pair of side walls comprise a one-side wall in the one-side portion and an other-side wall in the other-side portion, wherein the inside corner portion is formed in each of the one-side wall and the other-side wall, wherein the inside corner portion formed in the other-side wall is greater than the inside corner portion formed in the one-side wall in width in the right and left direction, and wherein a thickness of a portion or an entirety of a portion of the upper wall which is nearer to the one-side wall than to the other-side wall is greater than that of a portion or an entirety of a portion of the upper wall which is nearer to the other-side wall than to the one-side wall.

8. The white key according to claim 5, wherein the pair of side walls comprise a one-side wall in the one-side portion and an other-side wall in the other-side portion, wherein the inside corner portion is formed in the other-side wall and is not formed in the one-side wall, and wherein a thickness of the one-side wall in the right and left direction is greater than that of the other-side wall in the right and left direction.

9. The white key according to claim 5, wherein the pair of side walls comprise a one-side wall in the one-side portion and an other-side wall in the other-side portion, wherein the inside corner portion is formed in each of the one-side wall and the other-side wall, wherein the inside corner portion formed in the other-side wall is greater than the inside corner portion formed in the one-side wall in width in the right and left direction, and wherein a thickness of the one-side wall in the right and left direction is greater than that of the other-side wall in the right and left direction.

10. The white key according to claim 3, wherein at least one of the pair of side walls comprises an inside corner portion which divides the at least one side wall into a front side wall and a rear side wall in the front and rear direction, wherein the narrow portion is located at a rear of the inside corner portion of the white key, and wherein the wide portion is located in front of the inside corner portion of the white key.

11. The white key according to claim 10, wherein the pair of side walls comprise a one-side wall in the one-side portion and an other-side wall in the other-side portion, wherein the inside corner portion is formed in the other-side wall and is not formed in the one-side wall, and wherein the weight is mounted on the inside surface of the upper wall in the one-side portion and is not mounted on the inside surface of the upper wall in the one-side portion.

12. The white key according to claim 10, wherein the pair of side walls comprise a one-side wall in the one-side portion and an other-side wall in the other-side portion, wherein the inside corner portion is formed in each of the one-side wall and the other-side wall, wherein the inside corner portion formed in the other-side wall is greater than the inside corner portion formed in the one-side wall in width in the right and left direction, and wherein the weight is mounted on the inside surface of the upper wall in the one-side portion and is not mounted on the inside surface of the upper wall in the one-side portion.

13. The white key according to claim 10, wherein the pair of side walls comprise a one-side wall in the one-side portion and an other-side wall in the other-side portion, wherein the inside corner portion is formed in the other-side wall and is not formed in the one-side wall, and wherein the weight is mounted on the inside surface of the one-side wall and is not mounted on the inside surface of the other-side wall.

14. The white key according to claim 10, wherein the pair of side walls comprise a one-side wall in the one-side portion and an other-side wall in the other-side portion, wherein the inside corner portion is formed in each of the one-side wall and the other-side wall, wherein the inside corner portion formed in the other-side wall is greater than the inside corner portion formed in the one-side wall in width in the right and left direction, and wherein the weight is mounted on the inside surface of the one-side wall and is not mounted on the inside surface of the other-side wall.

* * * * *